United States Patent [19]

Alexander, III

[11] 4,252,154

[45] Feb. 24, 1981

[54] LOOM TAKEUP APPARATUS

[76] Inventor: William J. Alexander, III, 41 W. Golden Strip Dr., Mauldin, S.C. 29662

[21] Appl. No.: 44,853

[22] Filed: Jun. 4, 1979

[51] Int. Cl.[3] ..... D03D 49/20; B65H 17/12

[52] U.S. Cl. ..... 139/304; 242/66; 242/76; 242/158.1; 139/307

[58] Field of Search ..... 139/304, 307, 308, 313; 242/66, 76, 158.1, 67.1 R, 67.3 R, DIG. 2

[56] References Cited

U.S. PATENT DOCUMENTS

| | | | |
|---|---|---|---|
| 2,130,332 | 9/1938 | Davis | 242/67.1 |
| 2,353,653 | 7/1944 | Croft et al. | 242/76 |
| 2,485,705 | 10/1949 | Croft et al. | 242/76 |
| 2,672,299 | 3/1954 | Jones | 242/57.1 |
| 2,903,195 | 9/1959 | Penland et al. | 242/67.3 |
| 3,433,430 | 3/1969 | Sprague | 242/66 |
| 3,642,222 | 2/1972 | Legsinger | 242/66 |

*Primary Examiner*—Henry Jaudon
*Attorney, Agent, or Firm*—Bailey, Dority & Flint

[57] ABSTRACT

A loom takeup apparatus is illustrated wherein cloth is fed directly from the loom to the takeup utilizing an oscillating roll which is slidably mounted for axial oscillation on the longitudinal axis of the roll for distributing the cloth so that the edge or selvage portions which are often thickened do not remain in register but rather build in such a fashion as to avoid excessively large end portions of the roll.

3 Claims, 3 Drawing Figures

LOOM TAKEUP APPARATUS

BACKGROUND OF THE INVENTION

According to the prior art, oscillating supply rolls have been used for varying the register of the edge portion of webs such as paper as illustrated in U.S. Pat. No. 2,130,332. Such apparatus contemplates an arrangement for oscillating the supply roll rather than the takeup roll and involves a special drive mechanism for accomplishing this purpose. Oscillating rolls have also been provided which pivot about a center portion of the roll up and down so as to move the selvages of the cloth in a regular fashion out of register during takeup of a web such as cloth from a loom and the like and such is illustrated in U.S. Pat. No. 2,485,705. Such apparatus, however, does not contemplate movement of the roll in oscillating fashion along its longitudinal axis. Other means for oscillating rolls about a pivotal axis include U.S. Pat. No. 2,353,653. A sliding roll which is moved along its longitudinal axis, which is not rotatable is illustrated for controlling web registry in U.S. Pat. No. 2,672,299.

Accordingly, it is an important object of the present invention to provide a loom takeup apparatus which employs an oscillating roll which oscillates along its longitudinal axis to avoid registry of the selvage portions which are often thickened for the purpose of avoiding wrinkles and building a roll having an improved appearance.

Another important object of the invention is to avoid excessive buildup in the edge portions of a cloth roll as may result in excessive wear of the roll covering due to the forces exerted thereupon as a result of the uneven build of the cloth roll.

The selvages of cloth manufactured, for example, using a Sulzer weaving machine are especially pronounced in that a selvage tuck is employed therein which results in a particularly thickened selvage portion of the cloth. It has been found that by utilizing an oscillating roll which oscillates along its own axis in the takeup that a roll of considerably improved appearance may be produced in such a fashion as to avoid wrinkles with consequent damage to the roll and excessive wear upon the cloth during buildup and thereafter.

SUMMARY OF THE INVENTION

It has been found that loom takeup apparatus may be employed having an oscillating roll which moves from side to side along the longitudinal axis of the roll in such a fashion as to distribute the fabric being fed from the loom for takeup in such a fashion that the selvages of the cloth are not in register but rather wander from side to side during the buildup in such a fashion as to avoid excessive buildup in the end portions of the rolls.

BRIEF DESCRIPTION OF THE DRAWINGS

The construction designed to carry out the invention will be hereinafter described, together with other features thereof.

The invention will be more readily understood frm a reading of the following specification and by reference to the accompanying drawings forming a part thereof, wherein an example of the invention is shown and wherein:

FIG. 3 is a front elevation further illustrating the takeup constructed in accordance with the present invention with the drive mechanism therefor.

DESCRIPTION OF A PREFERRED EMBODIMENT

Figure 1:
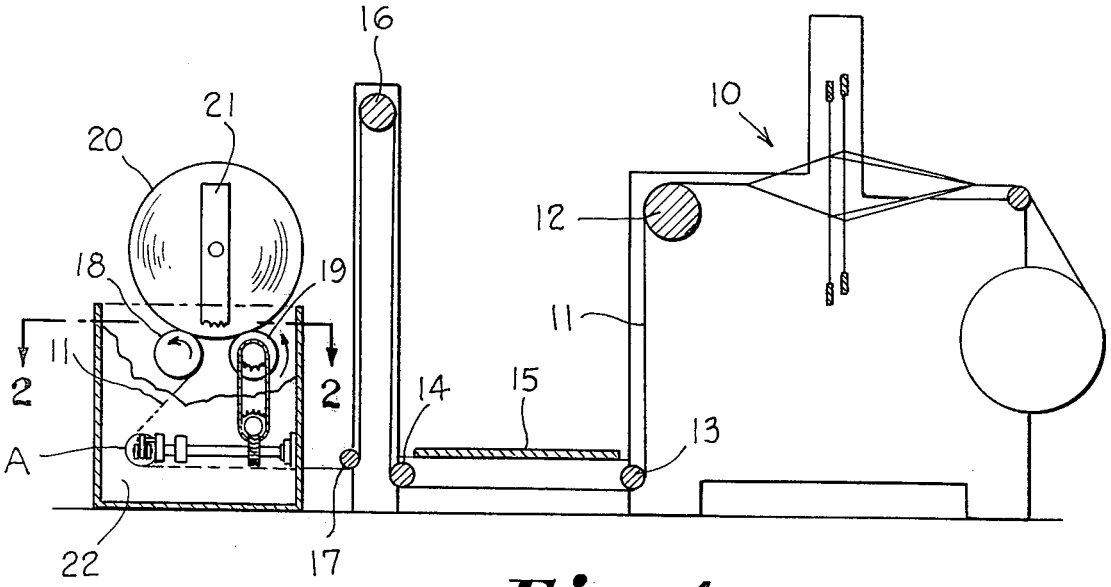
FIG. 1 is an end elevation illustrating a cloth being transported from a loom to a takeup constructed in accordance with the present invention.
Figure 2:
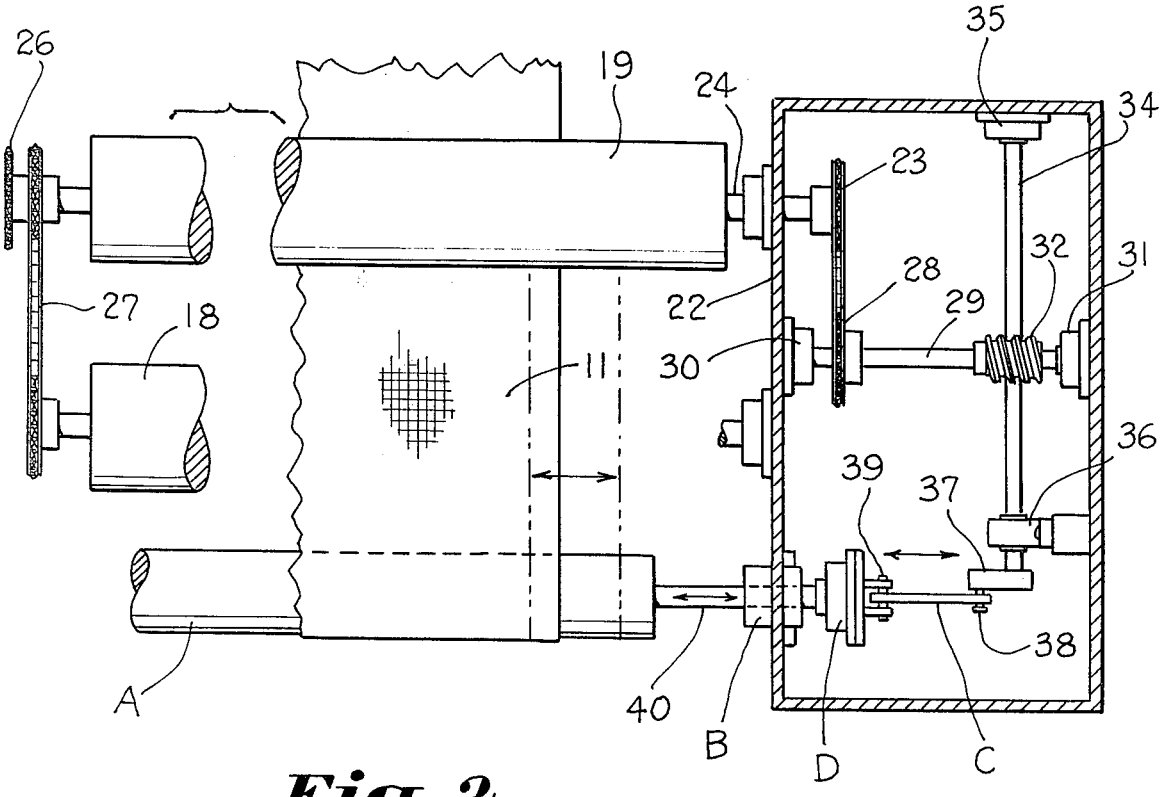
FIG. 2 is a top plan view partially in section, taken on the line 2—2 in FIG. 1.
Figure 7:
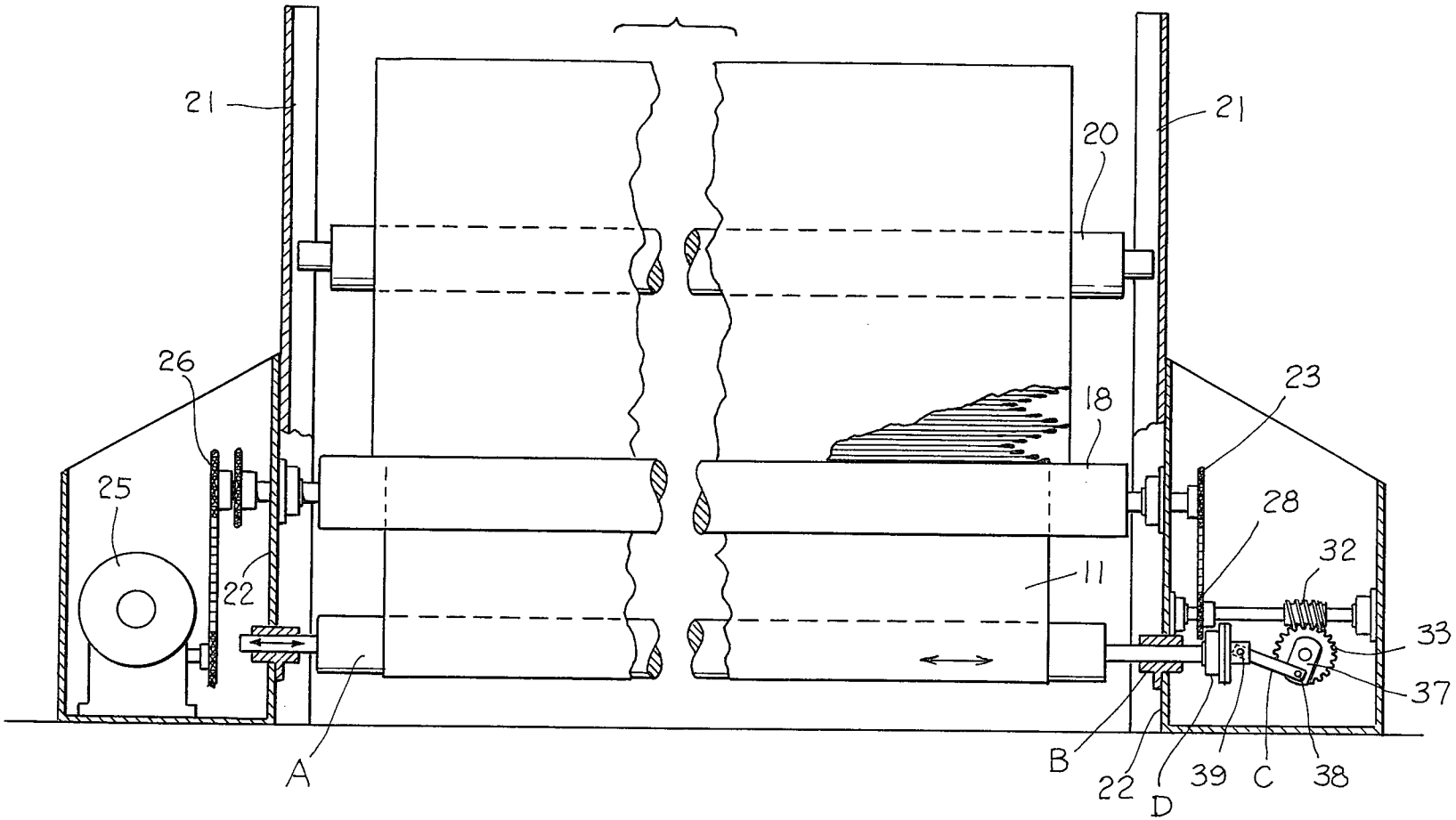

The drawings illustrate loom takeup apparatus having a cloth roll supported between a pair of drive rolls receiving cloth directly from a loom. A guide roll A adjacent the pair of driven rolls receives cloth from the loom in open width passing thereover to one of the driven rolls for winding on the cloth roll. Sliding bearing means B mount the guide roll for axial oscillatory sliding movement in parallel alignment with the pair of driven rolls. Linkage means C are driven for oscillatory movement by the driven rolls. The sliding bearing means B also serve as means for carrying the guide roll for rotation by the cloth passing thereover. Means D connect the linkage means to the guide roll for imparting oscillatory movement thereto for distributing the cloth upon the cloth roll.

The drawings illustrate a loom broadly designated at 10 wherein cloth 11 is fed over a roll 12 for takeup. The cloth passes around a lower roll 13 as well as a roll 14 providing a horizontal run of cloth beneath the platform 15 carried in front of the loom. The cloth passes from beneath the platform over a roll 16 and beneath the guide roll 17 to the takeup mechanism. The cloth 11 passes beneath the guide roll A and over one of a pair of parallel support rolls 18 and 19 to be surface wound building a cloth roll 20 between the support rolls 18 and 19. The cloth roll 20 is illustrated as being carried in vertical standards 21 supported by suitable end frame members 22 which carry various of the rolls referred to herein.

The takeup roll A is illustrated as being carried in a sliding bearing B which is suitably positioned in the end frame member 22. A drive for oscillating the roll A is provided from one of the driven support rolls 18 and 19 through a sprocket 23. The sprocket 23 is carried by a shaft 24 of the roll 19. The roll 19 is driven from the gear motor 25 (FIG. 3) through the sprocket 26 and a chain 27 drives the adjacent support roll 18.

Referring now again to the drive or oscillating roll A, a sprocket 28 is driven from the sprocket 23 in order to turn a shaft 29 which is carried by suitable bearings 30 and 31. The shaft 29 carries a worm 32 for turning a worm gear 33 (FIG. 3) for rotating the shaft 34 which is carried in the bearings 35 and 36. The shaft 34 turns an eccentrically mounted cam 37 for actuating the linkage C which has pivotal connection at 38 upon the cam 37. The links C have pivotal connection as at 39 upon the means D which is illustrated in the form a self-aligning spherical outside diameter ball bearing. Such apparatus is often used, as here, to provide a flexible coupling as between the oscillating link which moves responsive to the eccentric and the shaft 40 upon which the guide roll A is mounted. The self-aligning ball bearing D has a spherically bored housing for providing the flexible coupling.

It is thus seen that a cloth takeup has been provided for use on a loom in such a fashion as to be especially useful with surface wound rolls so that a guide roll may be driven for oscillating movement along its own longitudinal axis so as to avoid excessive buildup in the selvage areas of the cloth roll. Such apparatus may be used however, upon looms which utilize an oscillating guide roll for carrying cloth to the takeup roll which may be mounted directly on the loom as well as in situations wherein the takeup roll, itself carried by the loom, is oscillated responsive to driving mechanism of the loom along its longitudinal axis. In the embodiment illustrated, it is significant that the cloth 11 turns the guide roll A by moving thereover and passing to the opposite side of the roll 18 for winding on the surface wound roll 20.

While a preferred embodiment of the invention has been described using specific terms, such description is for illustrative purposes only, and it is to be understood that changes and variations may be made without departing from the spirit and scope of the follwoing claims.

What is claimed is:

1. Loom takeup apparatus having a cloth roll supported between a pair of driven rolls receiving cloth directly from a loom comprising;

a guide roll adjacent said pair of driven rolls receiving cloth from the loom in open width passing thereover to one of said driven rolls for winding on said cloth roll;

means mounting said guide roll for axial oscillatory sliding movement in parallel alignment with said pair of driven rolls;

means driven for oscillatory movement;

means carrying said guide roll for rotation by said cloth passing thereover; and means connecting said means driven for oscillatory movement to said guide roll for imparting oscillatory movement thereto for distributing said cloth upon said cloth roll.

2. The structure set forth in claim 1, wherein said means driven for oscillatory movement are linkage means, and wherein said means connecting said means driven for oscillatory movement provide a flexible connection.

3. Loom takeup apparatus having a cloth roll supported for directly receiving cloth woven upon a loom comprising:

a guide roll receiving said cloth directly in open width passing thereover for winding on said cloth roll;

means mounting said guide roll for axial oscillatory sliding movement in alignment with the longitudinal axis of said roll;

means carrying said guide roll for rotation by said cloth passing thereover to said cloth roll; and means imparting oscillatory movement to said guide roll for distributing said cloth upon said cloth roll.

* * * * *

UNITED STATES PATENT AND TRADEMARK OFFICE

CERTIFICATE OF CORRECTION

PATENT NO. : 4,252,154

DATED : February 24, 1981

INVENTOR(S) : William J. Alexander III

It is certified that error appears in the above—identified patent and that said Letters Patent is hereby corrected as shown below:

Column 3, line 26, delete "adjacent said pair of driven rolls".

Column 4, line 25, "by" should read -- with --.

Signed and Sealed this

*Twenty-first* Day of *July 1981*

[SEAL]

*Attest:*

GERALD J. MOSSINGHOFF

*Attesting Officer*

*Commissioner of Patents and Trademarks*